US010170823B2

(12) United States Patent
Tatarnikov et al.

(10) Patent No.: US 10,170,823 B2
(45) Date of Patent: Jan. 1, 2019

(54) EMBEDDED ANTENNA DEVICE FOR GNSS APPLICATIONS

(71) Applicant: Topcon Positioning Systems, Inc., Livermore, CA (US)

(72) Inventors: Dmitry Vitalievich Tatarnikov, Moscow (RU); Andrey Vitalievich Astakhov, Moscow (RU); Pavel Petrovich Shamatulsky, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 189 days.

(21) Appl. No.: 15/124,053

(22) PCT Filed: Apr. 27, 2016

(86) PCT No.: PCT/RU2016/000249
§ 371 (c)(1),
(2) Date: Sep. 7, 2016

(87) PCT Pub. No.: WO2017/188835
PCT Pub. Date: Nov. 2, 2017

(65) Prior Publication Data

US 2018/0166773 A1 Jun. 14, 2018

(51) Int. Cl.

| | |
|---|---|
| ***H01Q 1/32*** | (2006.01) |
| ***H01Q 5/40*** | (2015.01) |
| ***H01Q 7/00*** | (2006.01) |
| ***H01Q 9/04*** | (2006.01) |
| ***H01Q 5/378*** | (2015.01) |

(52) U.S. Cl.
CPC ..... *H01Q 1/3233* (2013.01); *H01Q 1/3275* (2013.01); *H01Q 5/378* (2015.01); *H01Q 5/40* (2015.01); *H01Q 7/00* (2013.01); *H01Q 9/0414* (2013.01)

(58) Field of Classification Search
CPC ..... H01Q 1/1271; H01Q 1/12; H01Q 13/02; H01Q 13/18; H01Q 1/3275
USPC ..... 343/713, 878, 786, 789
See application file for complete search history.

(56) References Cited

U.S. PATENT DOCUMENTS 6,356,241 B1 * 3/2002 Jaeger ..... H01Q 13/0275 343/776
2008/0218418 A1 * 9/2008 Gillette ..... H01Q 1/38 343/700 MS

FOREIGN PATENT DOCUMENTS

WO WO00/24084 A1 4/2000

* cited by examiner

*Primary Examiner* — Dameon E Levi
*Assistant Examiner* — Collin Dawkins
(74) *Attorney, Agent, or Firm* — Bardmesser Law Group

(57) ABSTRACT

An antenna assembly includes a GNSS stacked patch antenna located in a metal cavity and a matching parasitic element, the matching parasitic element includes a set of conductors not connected to the antenna. Each conductor has an external end and internal end, the external ends being conductively coupled to the housing of the cavity. The conductors of the matching parasitic elements can be radially arranged. External ends of conductors are additionally connected to each other by a ring-shaped conductor. Internal ends of conductors can be connected to capacitive elements, which can be discrete capacitors and/or segments of conductors.

7 Claims, 7 Drawing Sheets

VSWR

EMBEDDED ANTENNA DEVICE FOR GNSS APPLICATIONS

BACKGROUND OF THE INVENTION

Field of the Invention

This invention relates to an antenna assembly to be installed in a vehicle or in a navigation receiver, and allows minimizing dimensions in height, as well as providing a capability of multiple use of the same antenna for different applications without major modifications in antenna design.

Description of the Related Art

Global navigation satellite systems (GNSS) signals are often used in many practical applications to precisely determine a position. Modern agricultural and construction machinery is an example of such use. GNSS signals are received by an antenna frequently mounted on the roof of a vehicle thereby increasing the total height of the vehicle. For tractors and some other vehicles, such a height increase is undesirable, since there are transportation limitations which should not be exceeded. Another design solution of antenna arrangement is its integration into a GNSS receiver, which often leads to an undesirable increase in overall dimensions of the receiver.

One possible solution for this problem is to place the antenna inside the housing of the vehicle or GNSS receiver, thereby preventing it from exceeding required overall size. U.S. Pat. No. 8,175,450 discloses a radiation element of a patch antenna partially or fully arranged in a cavity. The cavity is a cylinder that can be regarded as a cylindrical waveguide shorted out by a metal wall from one side. The full GNSS range is divided into two frequency bands: low-frequency (LF) (about 1165-1300 MHz) and high-frequency (HF) (about 1525-1605 MHz). If its diameter is approximately 100-120 mm, this waveguide becomes supercritical for the low-frequency band. In this case the antenna's frequency band narrows, which can be compensated by an increase in its height. In U.S. Pat. No. 8,175,450 such a height for the radiator operating in the LF band is 22 mm. The presence of the cavity also results in changing antenna's characteristics, and there is a need to adjust the antenna, considering possible effects of the cavity. Such adjustments normally cause some alterations in the antenna design. The latter makes it difficult to employ the same antenna design in different products, for example, in products with as well as without the above-mentioned cavity.

U.S. Pat. No. 6,833,815 suggests using a meander line antenna also arranged in the product cavity. Some bent elements are used in this case, one end of which is connected to elements of the radiator, and the other is connected to the cavity wall. The availability of such a contact between the antenna elements and cavity can cause an increase in currents flowing through the external surface of the product in the vicinity of the antenna. This, in turn, can result in an increase in undesirable electromagnetic coupling with some other radio electronic devices. This contact also complicates the use of the antenna together with products without a cavity.

The present invention thus provides a method of arranging GNSS antenna allowing a minimization of height dimensions of a device, and a multi-use of the antenna for different products without essential changes in its design.

SUMMARY OF THE INVENTION

Accordingly, the present invention is related to an embedded GNSS antenna that substantially obviates one or more of the disadvantages of the related art.

The present invention suggests arranging a navigation antenna in a metal cavity, the matching parasitic element being located at the top part of the cavity. This element is conductively-coupled with a housing of the cavity and has no direct connection with the antenna. In the absence of a direct connection, an absence of any physical connection between any part of the antenna and any part of the matching parasitic element is assumed. The antenna is normally designed for operation without the cavity.

The matching parasitic element is at least a set of radial conductors located along the perimeter of the cavity, one end of each conductor being coupled with the cavity housing. The matching parasitic element can also include capacitive components coupled with the radial conductors.

Due to the matching parasitic element, the diameter of the metal cavity can be reduced without a noticeable reduction in antenna's frequency bandwidth. By varying parameters of the matching parasitic element, the antenna can be adjusted in accordance with possible cavity effects without making noticeable changes in the existing antenna design.

Thus, the antenna may be installed in a cavity of a vehicle's roof or a housing of a device, so that elements of the antenna design would not fully or partially exceed required device dimensions. Any undesirable changes in antenna's operation mode caused by its arranging in the cavity are compensated for the matching parasitic element. Lack of a direct connection between antenna and the matching parasitic element allows a simple installation of a standard antenna, as well as a reduction of undesirable electromagnetic coupling with near devices.

In one embodiment, an antenna assembly includes a GNSS stacked patch antenna located in a metal cavity and a matching parasitic element, the matching parasitic element includes a set of conductors not connected to the antenna. Each conductor has an external end and internal end, the external ends being conductively coupled to the housing of the cavity. The conductors of the matching parasitic elements can be radially arranged. External ends of conductors are additionally connected to each other by a ring-shaped conductor. Internal ends of conductors can be connected to capacitive elements, which can be discrete capacitors and/or segments of conductors.

In another embodiment, an antenna assembly includes a metal cavity having a generally circular shape; a stacked patch GNSS antenna located in the metal cavity; and a conductive parasitic element shaped as a ring and located on top of the metal cavity. The parasitic element includes conductors that are not directly connected to the antenna, the set of conductors shaped as a plurality of teeth projecting radially inward from the ring. Optionally, each conductor has an external end and an internal end, the external ends being conductively coupled to the housing of the cavity.

Optionally, the conductors are radially equiangularly around the ring. Optionally, internal ends of the conductors are connected to capacitive elements that can be capacitors, segments of conductors, and a combination of the two. Optionally, the conductors are oriented at an angle to plane that is perpendicular to a symmetry axis of the antenna assembly, the angle being between 10 and 35 degrees. Optionally, the assembly includes a plastic radome on which the conductors are located. Optionally, the stacked patch antenna includes a radiating low-frequency patch and a radiating high-frequency patch, the high-frequency patch being above the low-frequency patch. Optionally, the radiating low-frequency patch is located on the same level as the parasitic element, or it can be located below the parasitic element.

The antenna assembly of claim 14, wherein the radiating low-frequency patch is located below the parasitic element.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

Figure 3A:
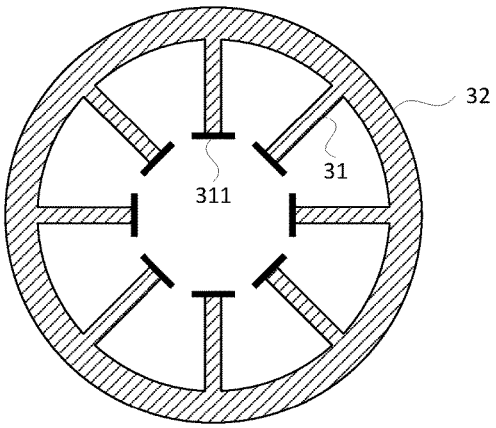
Figure 3B:
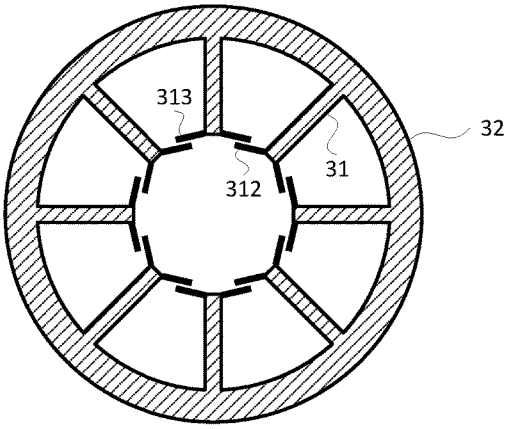
Figure 3C:
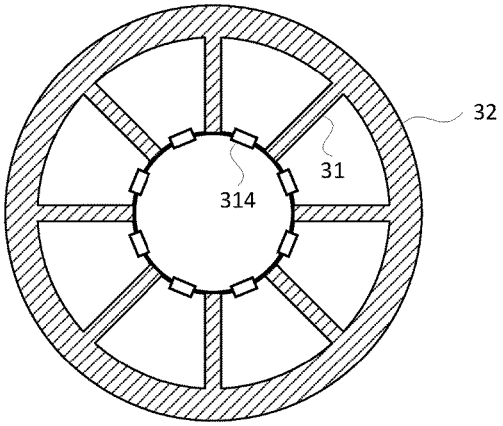

FIGS. 3A, 3B, and 3C show design styles of capacitive elements.

Figure 4:
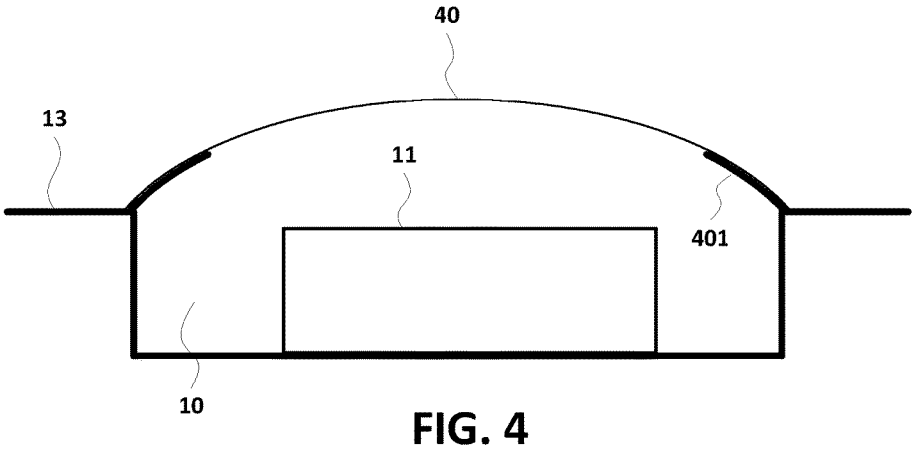

FIG. 4 presents an embodiment of a matching passive element.

Figure 5:
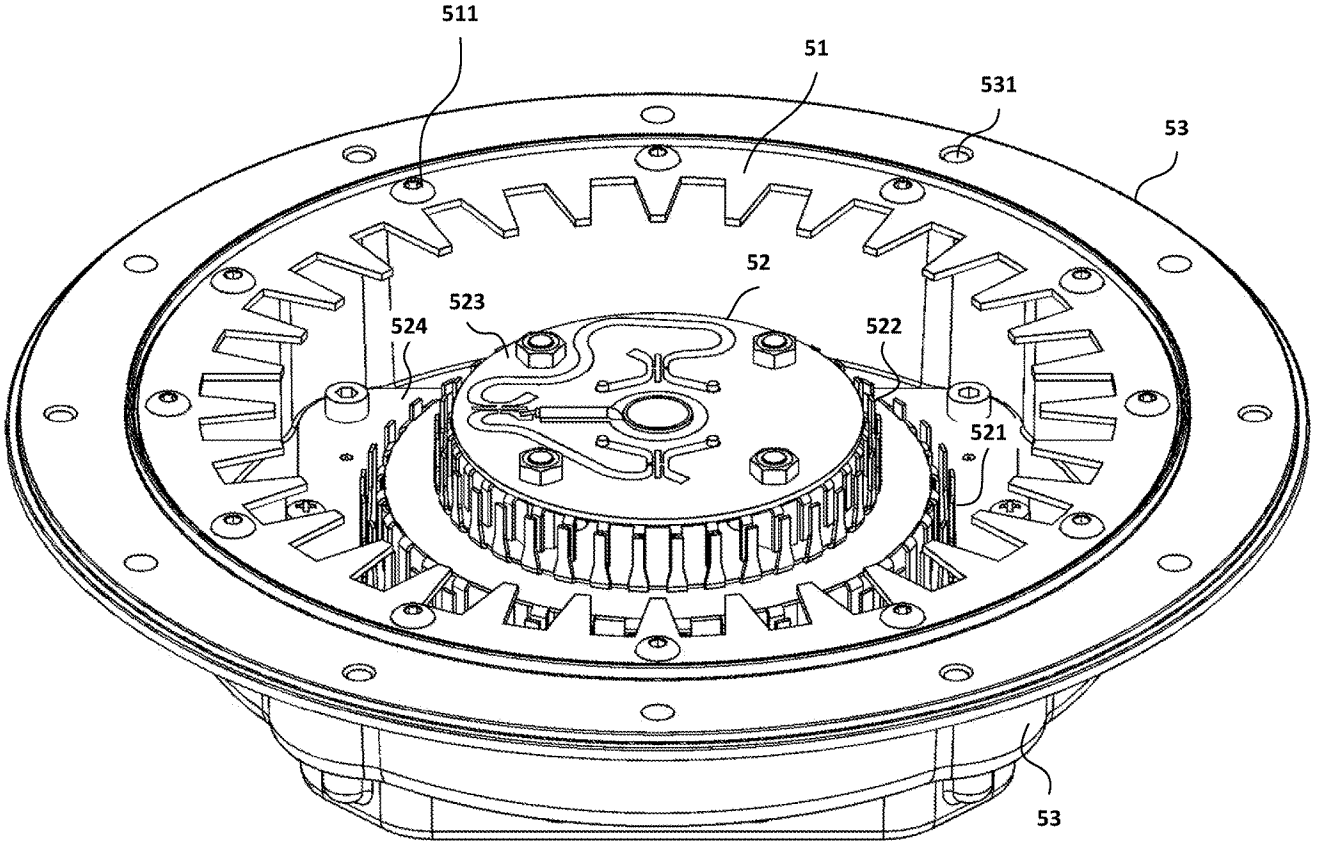

FIG. 5 shows an embodiment of an antenna assembly.

Figure 6:
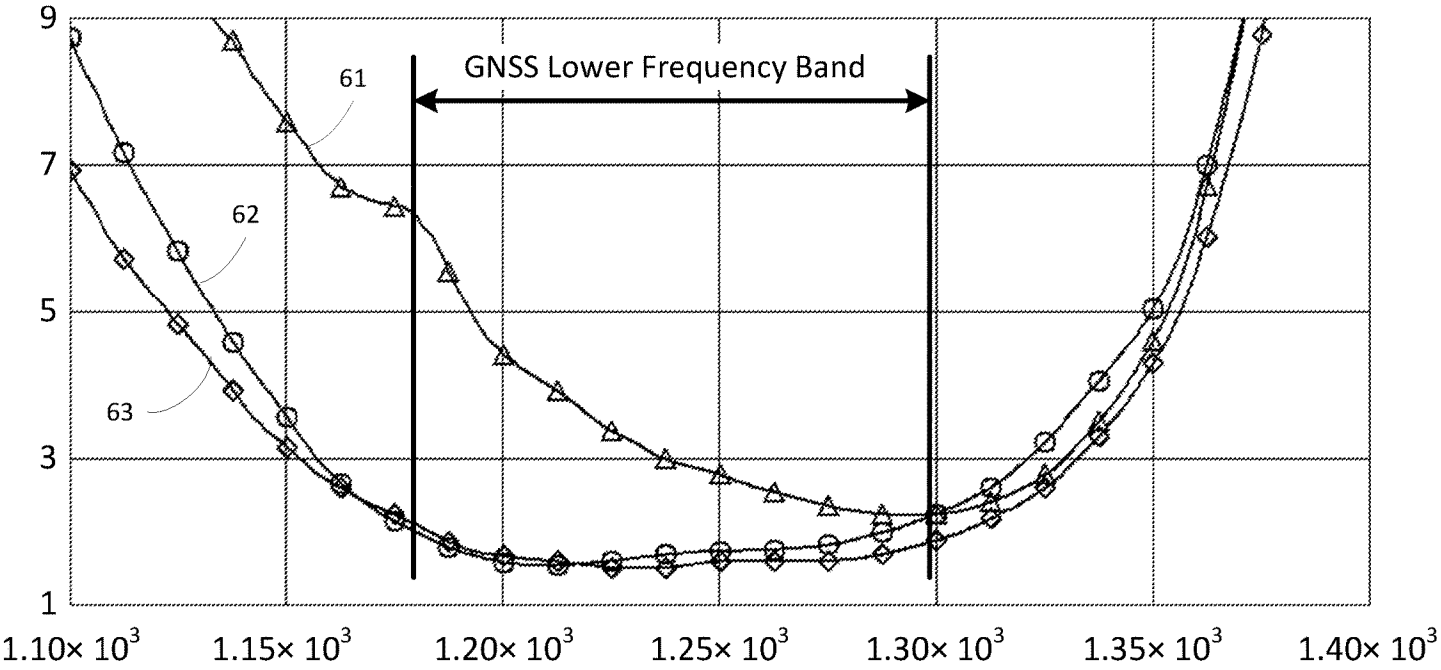

FIG. 6 presents graphs of standing-wave ratios.

Figure 7:
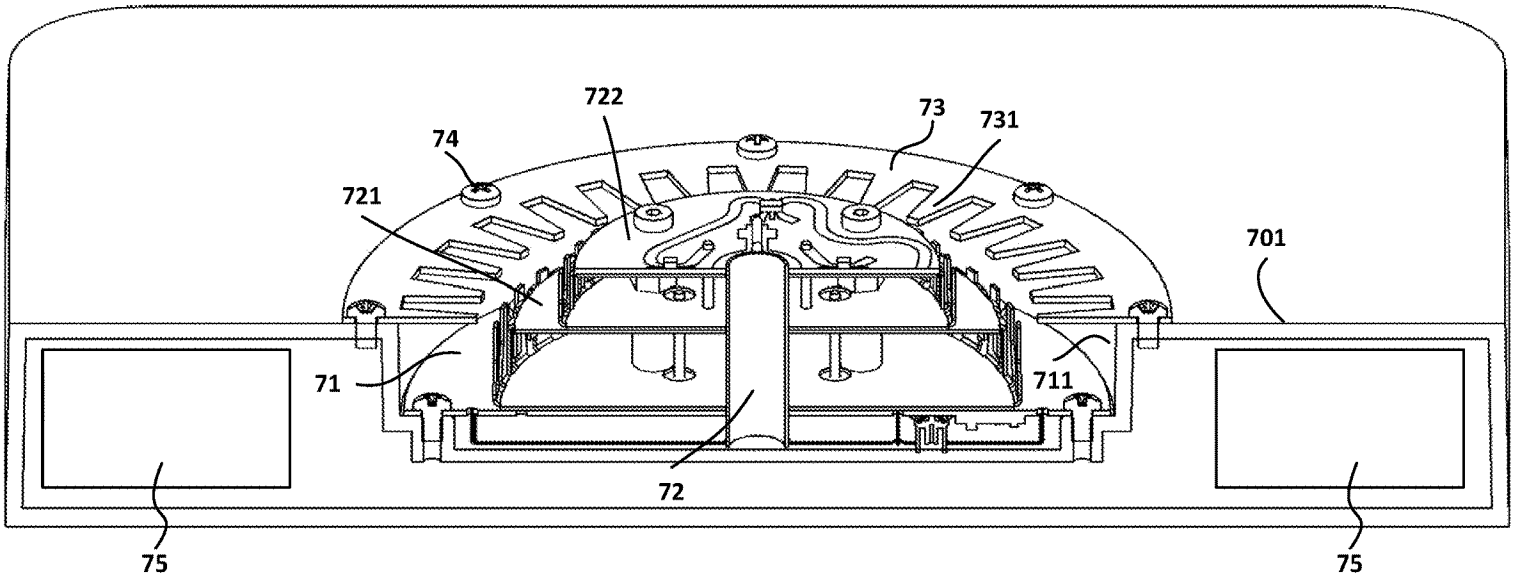

FIG. 7 shows an embodiment of an antenna assembly.

DETAILED DESCRIPTION OF THE PREFERRED EMBODIMENTS

Reference will now be made in detail to the preferred embodiments of the present invention, examples of which are illustrated in the accompanying drawings.

Figure 1A:
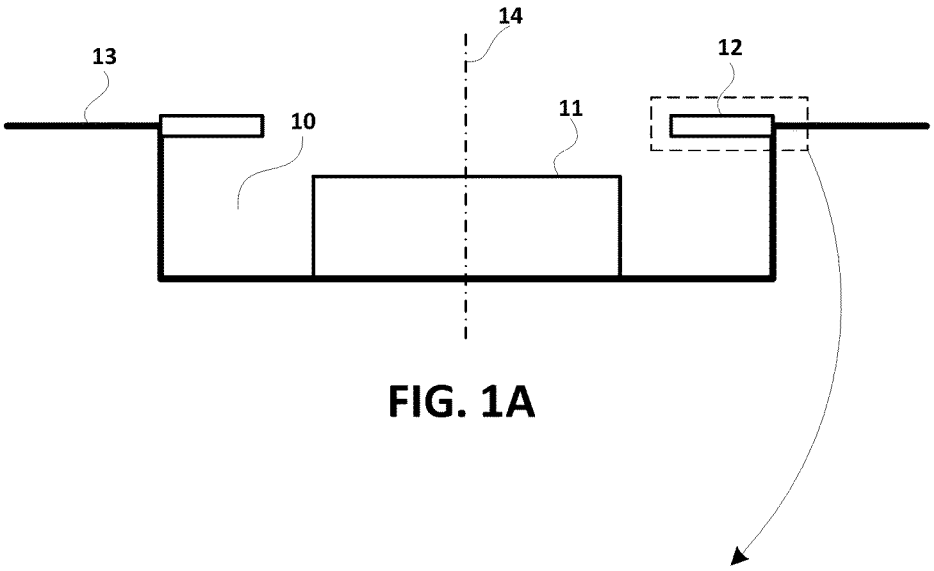
FIGS. 1A, 1B show a diagram of an antenna assembly and a matching passive element.
Figure 1B:
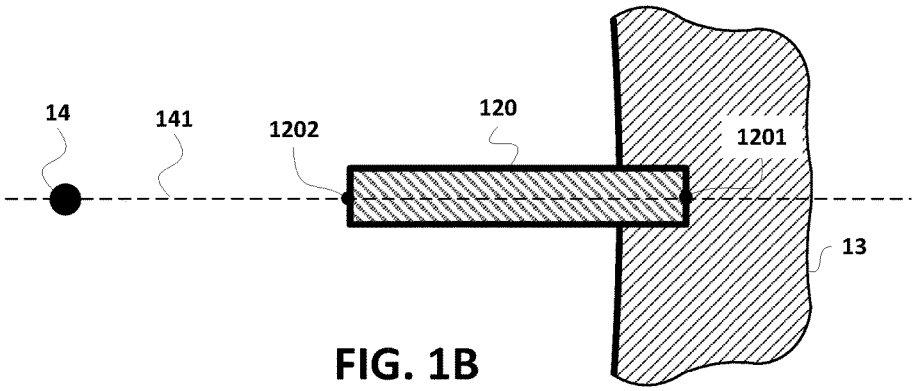

FIG. 1A presents an antenna assembly proposed by the present invention. It includes an antenna 11 installed in a metal cavity 10, the matching parasitic element 12 being at the top of the cavity.

The matching parasitic element is rotational symmetric relative to axis 14. The matching parasitic element does not have a direct connection with antenna.

A stacked patch antenna can be used as an antenna, which comprises a ground plane, a low-frequency radiating patch, a high-frequency radiating patch above it, and exciting pins. Also capacitive elements can be located along perimeters of the radiating patches.

The matching parasitic element includes a set of radial conductors 120, each of which has external end 1201 and internal end 1202. External (outer) ends of the conductors are located along the perimeter of the cavity and conductively coupled to its housing 13.

A radial conductor is a conductor located in a plane perpendicular to the symmetry axis 14, the conductor being on a line 141 crossing the symmetry axis 14.

Figure 2A:
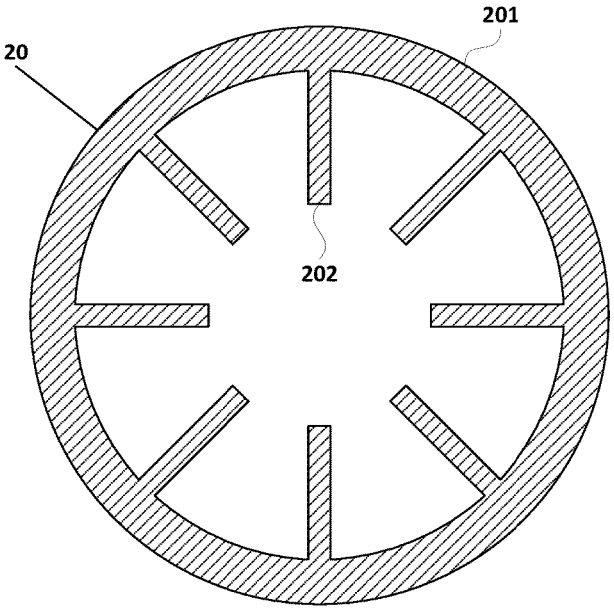
FIGS. 2A, 2B show an embodiment of a matching passive element.
Figure 2B:
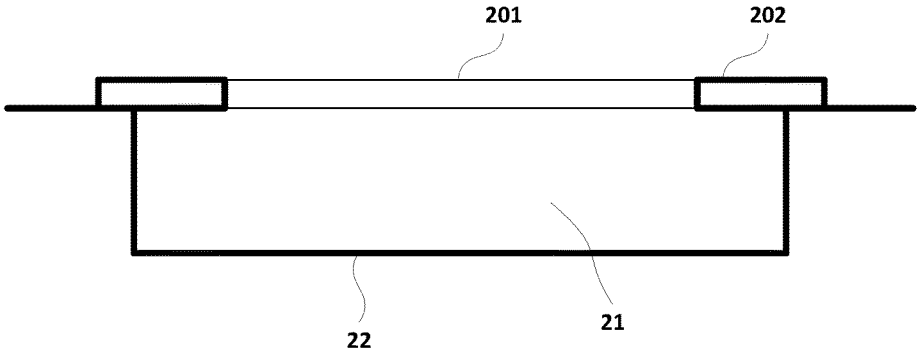

For the sake of convenience the radial conductors can be additionally connected to each other to form a single part. FIGS. 2A, 2B show one of embodiments of the matching parasitic element 20.

It is a metal ring 201 and a set of conductors 202, the external end of which is connected to the ring. The conductors are oriented along the radial directions. The ring is fastened to a housing 22 of the cavity 21 by screws and is conductively coupled to it.

Another embodiment of the invention includes a matching parasitic element made as a printed circuit board in which the ring and radial conductors are made in the form of metallization while a dielectric substrate forms a base. A further embodiment is a design wherein internal (inner) ends of conductors 31 are connected to capacitive elements. These capacitive elements can be made in the form of both capacitors 314 (FIG. 3C) and conductor segment 311, 312, 313 (FIGS. 3A, 3B).

FIG. 4 shows an embodiment where conductors of the matching parasitic element are arranged at a certain angle to the plane of the device housing 13. For example according to FIG. 4, the matching parasitic element can be made on a plastic cover 40 in the form of deposited metallization 401.

FIG. 5 shows another embodiment of the antenna assembly where the matching parasitic element 51 is made as a metal ring with cut-outs. There are following designations are used in this figure: 511 are the screws to six the matching parasitic element to the housing of the antenna assembly, 52 is the stacked patch antenna, 53 are the elements of the antenna housing, 531 are the holes for screws to fix the antenna assembly to the device housing with which the antenna assembly is integrated. Additionally, as shown in FIG. 5, the antenna has the following elements: low frequency radiator 521, high frequency radiator 522, high frequency excitation PCB board 523, LNA and low frequency excitation PCB board 524.

FIG. 6 shows a voltage standing wave ratio (VSWR) measurements in the low-frequency band for the following cases: a stacked patch antenna designed for GNSS operation without the cavity is located in the cavity without the matching parasitic element (graph 61), the same antenna in the cavity with the matching parasitic element (graph 62), and the antenna is on a flat ground plane, i.e., there is no cavity (graph 63). It is seen from the graphs that the placing the antenna in the cavity without the matching parasitic element has resulted in a noticeable antenna mismatch on the lower boundary of the band. The presence of the matching parasitic element has made SWR within operating band be the same as that of having no cavity. Exemplary parameters of an embodiment providing graph 62 are as follows: a diameter of the cavity is 110 mm, a depth of the cavity is 30 mm, a length of a conductor of the matching parasitic element is 15 mm.

Another embodiment discloses an antenna not fully placed in the cavity. FIG. 7 shows a design with a cavity 71 in a device housing 70. In this cavity there is a low-frequency part of the stacked patch antenna 72. A radiating patch 721 of the low-frequency band is on the same level as the top surface of a housing 701. A radiating patch of the high-frequency band 722 is above the surface 701. A matching parasitic element 73 is fixed to the housing surface by screws 74 such that its radial components 731 are arranged above the cavity. A partial lowering of the antenna in the cavity allows to reduce the cavity diameter. In addition, a GNSS receiver 75 can be also installed in the device housing.

Having thus described a preferred embodiment, it should be apparent to those skilled in the art that certain advantages of the described method and system have been achieved.

It should also be appreciated that various modifications, adaptations, and alternative embodiments thereof may be made within the scope and spirit of the present invention. The invention is further defined by the following claims.

What is claimed is:

1. An antenna assembly comprising:

a metal cavity having a generally circular shape;

a stacked patch GNSS antenna located in the metal cavity; and a conductive parasitic element shaped as a ring and located on top of the metal cavity, the parasitic element including conductors that are not directly connected to the antenna, the conductors shaped as a plurality of teeth projecting radially inward from the ring, wherein the stacked patch antenna includes a radiating low-frequency patch and a radiating high-frequency patch, the high-frequency patch being above the low-frequency patch.

2. The antenna assembly of claim 1, wherein the conductors are oriented at an angle to plane that is perpendicular to a symmetry axis of the antenna assembly, the angle being between 10 and 35 degrees.

3. The antenna assembly of claim 2, further comprising a plastic radome on which the conductors are located.

4. The antenna assembly of claim 1, wherein the radiating low-frequency patch is located on the same level as the parasitic element.

5. The antenna assembly of claim 1, wherein the radiating low-frequency patch is located below the parasitic element.

6. An antenna assembly comprising:

a metal cavity having a generally circular shape;

a stacked patch GNSS antenna located in the metal cavity; and a conductive parasitic element shaped as a ring and located on top of the metal cavity, the parasitic element including conductors that are not directly connected to the antenna, the set of conductors shaped as a plurality of teeth projecting radially inward from the ring, wherein each conductor has an external end and an internal end, the external ends being conductively coupled to the housing of the cavity, and wherein the internal ends of the conductors are connected to capacitive elements, the capacitive elements being any of:

a. capacitors;

b. segments of conductors, and c. capacitors and segments of conductors.

7. The antenna assembly of claim 6, wherein the conductors are arranged radially equiangularly around the ring.

* * * * *